United States Patent [19]

Brooks

[11] Patent Number: 4,784,121

[45] Date of Patent: Nov. 15, 1988

[54] KNEE EXERCISING DEVICE

[76] Inventor: Lester N. Brooks, 3027 Scott Rd., Oxford, Ohio 45056

[21] Appl. No.: 148,566

[22] Filed: Jan. 26, 1988

[51] Int. Cl.[4] ..... A61H 1/02; A63B 21/00

[52] U.S. Cl. ..... 128/25 R; 272/93; 272/126

[58] Field of Search ..... 128/24, 25 R, 25 B, 128/68, 80 R, 80 C, 80 F, 80 G, 88; 272/93, 96, 116, 117, 120, 121, 125, 126, 130, 137, 142

[56] References Cited

U.S. PATENT DOCUMENTS

| | | | |
|---|---|---|---|
| 2,405,024 | 7/1946 | Eynon | 272/126 X |
| 2,772,881 | 12/1956 | Fundom | 272/116 X |
| 2,815,020 | 12/1957 | Barkschat | 128/25 R |
| 3,000,632 | 9/1961 | Fuchs | 272/126 X |
| 3,089,700 | 5/1963 | Hotas | 128/25 R X |
| 3,612,042 | 10/1971 | Fry | 272/93 X |
| 3,792,860 | 2/1974 | Selnes | 272/126 |
| 4,114,610 | 9/1978 | Koch | 128/25 R |
| 4,373,716 | 2/1983 | Pagani | 272/137 |
| 4,466,613 | 8/1984 | Reese | 272/142 |
| 4,546,968 | 10/1985 | Silberman | 272/117 |
| 4,637,607 | 1/1987 | McArthur | 272/132 |
| 4,641,833 | 2/1987 | Trethewey | 272/130 X |

FOREIGN PATENT DOCUMENTS

| | | | |
|---|---|---|---|
| 0022002 | 1/1981 | European Pat. Off. | 272/93 |

*Primary Examiner*—Richard J. Apley
*Assistant Examiner*—Robert D. Bahr
*Attorney, Agent, or Firm*—Kinney & Schenk

[57] ABSTRACT

A knee exercising device is described. It provides for the manual control of pressure to the lower leg in selectively flexing either the right or left leg knee joint. The device includes a plate member interposed between the users buttocks and a chair sear on which the user is sitting. The leg of the knee being exercised is held in an elevated position by a pad between the thigh of that leg and the chair seat. A lever is pivotally mounted, intermediate its length, on the plate member. The lever swings in a vertical plane between the users legs about an axis generally vertically aligned with and parallel to the axis of the knee joint being exercised. A leg engaging pad is removably mounted on the lower end portion of the lever. The removable mounting enables the pad to be selectively positioned to engage the front, shin portion or rear calf portion or either leg, at an area adjacent to and spaced above the user's foot.

5 Claims, 2 Drawing Sheets

FIG-1
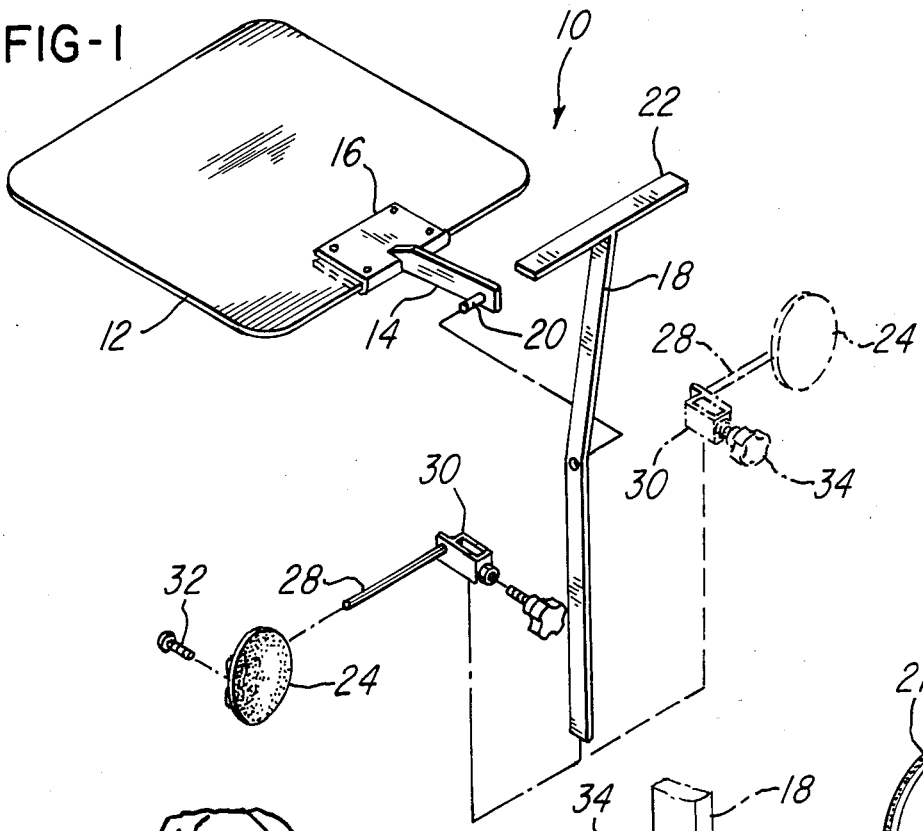
FIG-2
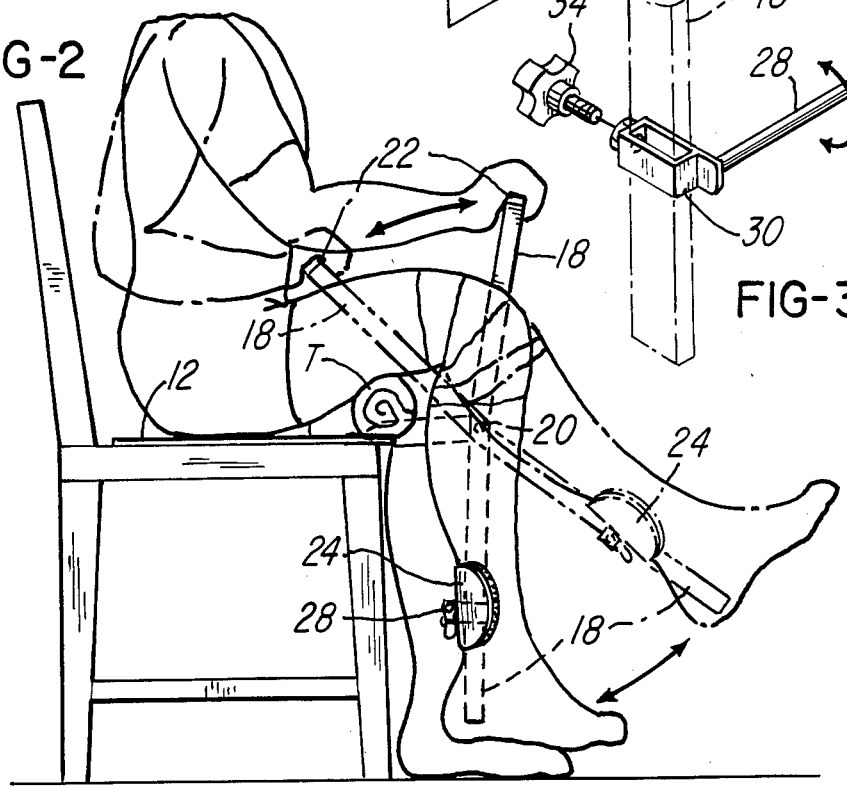
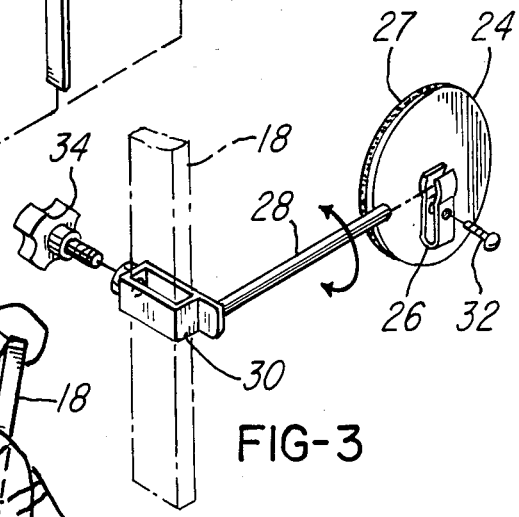
FIG-3

KNEE EXERCISING DEVICE

The present invention relates to improvements in devices for exercising a knee joint.

Several proposals are found, in the prior art, for exercising devices adapted to articulate, or flex, a knee joint. In accomplishing such end, these devices also bring into play calf and thigh muscles which extend and retract the lower leg. The recognized benefits are in minimizing joint stiffness and muscle atrophy after the joint has been fully or partially immobilized by disease or surgery.

One class of such exercisers simply flexes the knee joint with the user remaining passive. This type is exemplified by U.S. Pat. No. 2,815,020—Barkschat.

Another class of exercisers comprises devices which include bicycle type pedals. This type device depends solely on the user's leg muscles to attain flexure of the knee joint. U.S. Pat. No. 4,373,716—Pagani discloses a multi-function exerciser which includes a set of pedals for this purpose. It is also of interest in that it discloses a device which comprises a flat base which is interposed between the seat of a chair and the user's buttocks and partially positions the pedals for use.

A further class of exercisers provides upper body assistance, primarily through the user's arms in articulating the knee. This class has advantages in that the user is encouraged to and may use his leg muscles in flexing the knee joint, but, where those muscles are weak, can achieve a greater degree of flexion through the use of his arms. U.S. Pat. Nos. 2,772,881—Fundom, 3,000,632—Fuchs and 4,114,610—Koch exemplify this class.

The Fundom exerciser is relatively complicated. It has a further shortcoming in that flexion of the knee joint is not as fully controlled as would normally be desired.

The Fuchs and Koch exercisers are incorporated into the structure of chair. The Fuchs exerciser permits the selective exercising of one leg or the other but is unduly complex in achieving this end. The Koch device is inconvenient in use in that positioning of the user's legs, relative to the bar which retracts the lower legs, is awkward. Further it teaches arm muscle assistance only in the retract direction of flexing.

Although these devices provide the desired end of flexing a knee to alleviate stiffness and build up the leg muscles, nonetheless shortcomings still exist. This is the case particularly where there is a high degree of stiffness, or immobility. The prior devices fail to provide a degree of control over leg movement which allows the user to determine the rate and extent of movement consistent with his tolerance to the pain involved, or with his desire to stress the leg muscles.

A further shortcoming of the prior devices is that they are bulky and cumbersome, requiring a relatively large space for storage. Also, for the most part they are relatively complicated.

Accordingly the object of the present invention is to provide an improved knee exercising device which is effective in flexing a severely immobilized knee and in so doing to provide a high degree of manual control over the rate and degree of flexion.

Another object of the invention is to provide an improved means for applying pressure to a user's lower leg in flexing the knee joint.

A further object of the invention is to provide a simple, economical device for achieving these ends, and further to provide a device requiring a small space envelope for storage when not in use.

The foregoing ends are attained by a knee exercising device which is to be used by a user sitting on a chair, or the like. A spacer is placed between the chair seat and the thigh, of the knee to be exercised, to elevate that leg.

The device comprises a relatively thin, plate member which is interposed between the buttocks of the user and the chair seat to position the device relative to the user's knees.

A lever is pivotally mounted, intermediate its length, on the plate member for movement, between the legs of the user in a vertical plane. The pivot axis of the lever is positioned generally parallel to and in vertical alignment beneath the knee being exercised.

A leg engaging pad is mounted on the lower end portion of the lever and positioned to engage the lower leg of the knee being exercised, in an area adjacent to and spaced above the user's foot.

The user may then manually displace the upper end of the lever to apply a controlled pressure on the lower leg in flexing the knee joint.

Preferably, the means employed for mounting the leg engaging pad include means for selectively engaging the rear surface of either the right leg or the left leg and the front surface of either leg. These means may, advantageously take the form of a laterally projecting rod on which the leg engaging pad is mounted, with means for selectively positioning the rod on the lever so that the rod projects toward the right or the left.

Additionally, the rod may project from a bracket which is releasably secured to the rod. The lever has a non-circular cross section which is received by an opening of corresponding cross section in the bracket. This permits the bracket to be rotated relative to the lever whereby the rod can be mounted to project either to the right or the left.

Further the leg engaging pad preferably has a front surface which is generally smooth and concave for engaging the leg. A clamp is then provided on the rear surface of the pad. The laterally projecting rod is of circular cross section, permitting the front surface of the rod to be positioned, selectively, for engagement with either the front surface or rear surface of the lower leg of the knee being exercised.

The above and other related objects and features of the invention will be apparent from a reading of the following description of a preferred embodiment, with reference to the accompanying drawings, and the novelty thereof pointed out in the appended claims.

In the drawings:

FIG. 1 is an exploded, perspective view of an exercising device embodying the present invention;

FIG. 2 is a side view of the exercising device, illustrating its use;

FIG. 3 is an exploded, perspective view, on an enlarged scale, illustrating an alternate position of components of the device;

Figure 4:
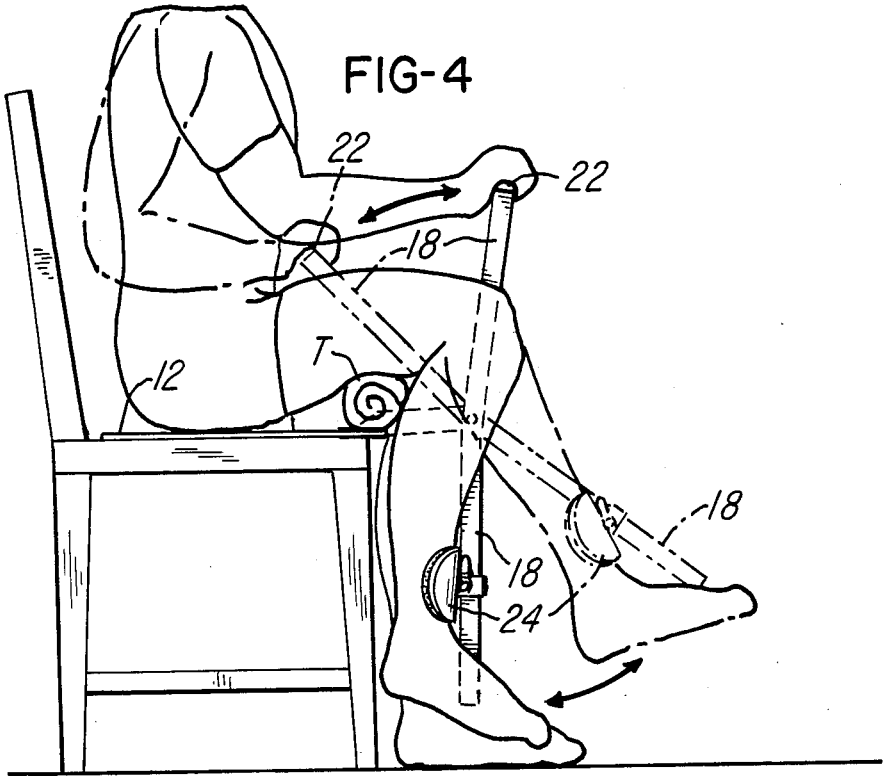
FIG. 4 is a side view of the device illustrating an alternate method of its use.

The present knee exercising device, generally identified by reference character 10, comprises a thin, flat plate member 12, FIG. 1. A bar 14 projects from the forward edge of the plate member 12, being mounted thereon by a bracket 16. A lever 18 is pivotally mounted, intermediate its length, on the bar 14 by a pin 20 projecting therefrom.

A T-bar 22 is provided at the upper end of the lever 18, to facilitate movement of the lever in a manner later described.

A lower-leg engaging pad 24 is adjustably mounted on the lower portion of the lever 18. More specifically, a clamp 26 is provided centrally of the rear side of the pad 24, FIG. 3. The opposite or front side of the pad 24 is generally smooth and, preferably concave. Also, preferably, the front surface of the pad 24 is formed of a relative soft layer 27, as foam rubber.

The clamp 26 is slid over a rod 28 projecting from a bracket 30. A screw 32 may employed to tighten the clamp 26 and hold the pad 24 in a desired position on the rod 28. The bracket 30 has an opening of rectangular cross section permitting it to be is telescoped over the lower end of the lever 18 which has a corresponding rectangular cross section. The bracket 30 is then held in a desired position on the lever 18 by a screw 34.

FIG. 2 illustrates the use of the device 10 to extend the leg in flexing the knee joint. The user places the plate member 12 on the seat of a conventional chair and then sits on the plate member 12, thus positioning the device for use. The plate member 22 may be readily shifted to position the pivot axis of the lever 18 generally parallel to and in vertical alignment beneath the pivot axis of the knee joint. The lever 18 is also positioned between the users knees for swinging movement in a vertical plane.

One foot of the user may rest comfortably on the floor. The leg to be exercised is elevated by placing a separate spacer, as a rolled towel T beneath the thigh of that leg.

The bracket is adjusted on the lever 18 to position the pad 24 for engagement with the rear surface of the user's leg, in the area at the lower end of his calf muscle, the pad 24 having previously been positioned on the rod 28 with its concave surface facing forwardly for engagement with the rear surface of the lower leg.

Having the device thus adjusted and with the user's leg positioned as illustrated in FIG. 2, the knee joint may then be flexed through extension of the lower leg, by manually gripping the T-bar 22. It is to be noted that, where a user's knee is badly immobilized, i.e., very stiff, he may be gently positioned as illustrated in FIG. 2, with a minimum of discomfort.

Then, when the knee is flexed, the user has complete control of lower leg movement through manipulation of the lever 18. Thus the user may progressively increase extension of the lower leg at a rate and to an extent, consistent with degree of pain which he wishes to tolerate. He may pause and then further increase extension, all within his own abilities.

When the lower leg has been extended to the point desired by the user, he may then control movement of the lever in the opposite direction. Gravity then acts to return the lower leg to its initial retracted position. The rate of return is manually controlled, again permitting the user to control the pain incident to this flexion so that his tolerance to the pain need not be exceeded.

It is to be noted that the described device has the capability of imparting essentially pure pivotal movement to the knee joint. The use of a pad engaging the rear surface of the lower leg enable relative sliding movement therebetween. Thus the force on the lower leg, as the lever is pivoted in a counter-clockwise direction, is essentially normal to the lower leg. This provides a torque force, relative to the axis of the knee joint and produces essentially pure pivotal movement, about the knee axis.

FIG. 2 illustrates the device adjusted for exercise of the user's right knee joint. It is a simple matter to exercise the left knee joint. The bracket 30 is loosened, slid off, rotated and then repositioned on the lower end of the lever 18 with the rod 28 projecting in the opposite, leftward direction. The pad 24 is then rotated relative to the rod 28 to bring its front face to a forwardly facing direction for engagement with the rear of the left lower leg, see phantom position of FIG. 1.

As indicated, the present device has particular benefit where the knee joint is extremely stiff, in providing controlled flexion in returning free movement of the joint. It also enables, through manual control of the upper end of the lever, the provision of a resisting force to retraction of the lower leg. Thus, when the pain of movement has alleviated, the muscles employed in retracting the lower leg may be tensioned against this resisting force.

Figure 5:
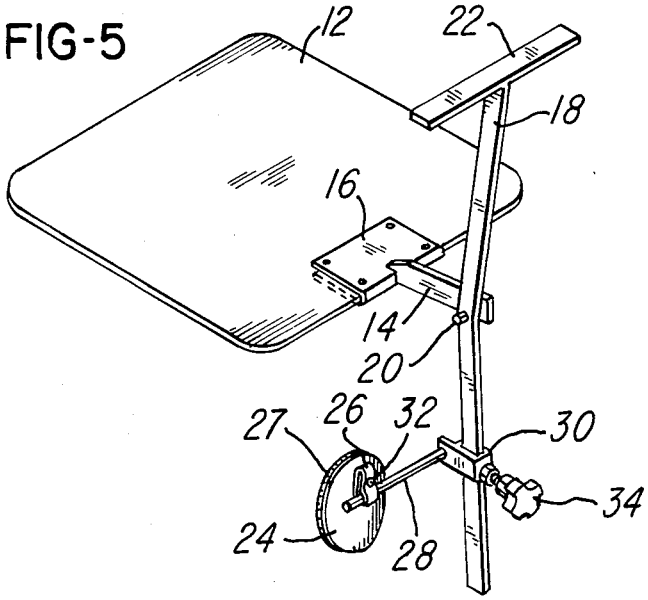
FIG. 5 is a perspective view of the present device, as it is used in FIG. 4.

The device 10 may also be readily adjusted to provide for controlled movement of the lower leg in extension. This is illustrated in FIGS. 4 and 5. The adjustment requires only rotation of the pad 24, relative to the rod 28, so that its front face is facing in a rearward direction for engagement with the shin of the user.

When thus adjusted and positioned, as shown in FIG. 4, the user may manually control the pressure opposing extension of the lower leg in flexing the knee joint. Again, the user may build up his muscles through exercise within the extent of his physical capabilities.

It will be apparent that in using the present device, the upper body muscles and particularly the user's arm muscles are also exercised. The device thus has the capability of being used as an arm exerciser, incident to its primary purpose of being a knee exerciser.

A further advantage of the present device is that it is capable of being stored with a minimum space requirement. This is to say that the lever 18 may be swung essentially flat against the plate member 12. Thus the space envelope of the device in this condition is relatively small, without requiring dissembly of the device.

Various modifications of the described embodiment will occur to those skilled in the art within the scope and spirit of the present inventive concepts as are defined the following claims.

Having thus described the invention, what is claimed as novel, and desired to be secured by Letters Patent of the United States is:

1. A knee exercising device for use by a user sitting on a chair, or the like, with the leg of the knee to be exercised being raised by a spacer placed between the thigh of that knee and the seat of the chair, said device comprising a relatively thin, plate member adapted to be interposed between the buttocks of the user and the chair seat and position the device relative to the user's knees, said plate member being removably positioned on the chair seat, a lever disposed between the legs of the user and pivotally mounted, intermediate its length, on said plate member for movement about a horizontal pivot axis, the pivotal axis of the lever being positioned generally parallel to and in general vertical alignment beneath the pivot axis of the knee joint, the upper portion of said lever being engagable by the user, a leg engaging pad, and means for mounting said pad on the lower portion of said lever for engagement with the lower leg, of the knee being exercised, in an area adjacent to and spaced above the user's foot, whereby the user may manually displace the upper end of the lever to apply a controlled pressure on the lower leg in flexing the knee joint.

2. A knee exercising device as in claim 1 wherein the means for mounting said pad further include a laterally projecting rod to which the pad is secured and means for selectively positioning said mounting means on the lever with the rod projecting to the left or to the right.

3. A knee exercising device as in claim 2 wherein the laterally projecting rod is of circular cross section, and the pad has a front, leg engaging face and a clamp on its rear face for securing it to said laterally projecting rod, permitting the pad to be engaged, selectively, with the front, shin portion of the leg or the rear calf portion of the leg.

4. A knee exercising device as in claim 3 wherein the lower portion of the lever is of non-circular cross section, and the mounting means include a bracket having an opening with a cross section corresponding to the cross section of the lower portion of said lever, said rod projecting from said bracket and said bracket being slidable on the lower end of said lever, and means for releasably clamping said bracket on said lever, said bracket being removable from said lever to permit its rotation relative to the lever and mounting thereon so that the laterally projecting rod may, selectively, extend to the right or left.

5. A knee exercising device as in claim 4 wherein a bar projects from the plate member and the lever is pivotally mounted thereon, a T bar is provided at the upper end of the lever to facilitate its manual movement, and the front, leg engaging face of the pad is generally smooth and concave.

* * * * *